United States Patent [19]

Nakagawasai

[11] 4,195,698

[45] Apr. 1, 1980

[54] MACHINE FOR DRIVING VERTICAL MEMBERS

[76] Inventor: Tadashi Nakagawasai, Kawasaki, Japan

[21] Appl. No.: 871,093

[22] Filed: Jan. 20, 1978

[30] Foreign Application Priority Data

| | | | |
|---|---|---|---|
| Jan. 29, 1977 | [JP] | Japan | 52/9028 |
| Apr. 7, 1977 | [JP] | Japan | 52/39793 |
| Jul. 6, 1977 | [JP] | Japan | 52/89654[U] |

[51] Int. Cl.[2] ..... E21B 3/02; E02D 5/34

[52] U.S. Cl. ..... 173/44; 173/147; 175/171; 405/232

[58] Field of Search ..... 173/42, 43, 44, 18, 173/19, 147; 254/139, 148, 175.3, 186 R; 175/91, 171; 405/232, 241, 249, 303

[56] References Cited

U.S. PATENT DOCUMENTS

| | | | |
|---|---|---|---|
| 3,420,320 | 1/1969 | Washita | 173/43 |
| 3,642,078 | 2/1972 | Dornfeld et al. | 175/171 |
| 3,734,212 | 5/1973 | Perlewitz | 175/171 |
| 3,869,003 | 3/1975 | Yamada et al. | 175/171 |
| 3,881,555 | 5/1975 | Cresp | 173/43 |
| 3,917,005 | 11/1975 | Cannon et al. | 173/43 |
| 3,919,816 | 11/1975 | Ranft | 173/43 |
| 4,050,526 | 9/1977 | Deike | 173/43 |
| 4,094,156 | 6/1978 | Dumont | 175/171 |
| 4,147,457 | 4/1979 | Washida | 405/232 |

FOREIGN PATENT DOCUMENTS

| | | | |
|---|---|---|---|
| 2535865 | 2/1976 | Fed. Rep. of Germany | 405/232 |
| 7408027 | 12/1974 | Netherlands | 405/303 |
| 1303195 | 1/1973 | United Kingdom | 405/232 |

*Primary Examiner*—Lawrence J. Staab

[57] ABSTRACT

A building machine wherein a leader is supported vertically during an operation, an endless chain is engaged around upper and lower sprockets of said leader, and a base body is mounted on said chain and is forced to move vertically along said leader. A pile which is a member to be driven in, is mounted on a pile holding portion of said base body.

3 Claims, 12 Drawing Figures

MACHINE FOR DRIVING VERTICAL MEMBERS

This invention relates to such a building machine as an earth auger, a pile driving machine and so forth.

Heretofore, in case of an earth auger, for example, a downward propelling force to drive a rotating auger screw into the ground has depended upon a weight member which has to be very heavy. A inherent weight of a decelerator or the like which is arranged on top of the auger screw, has been adopted for said weight member. If said decelerator is designed in a large size and a heavy weight, the mounting thereof is not easy, and its transportation by a truck can be unstable and inconvenient. As for means to drive a pile into the ground, for another example, two means are considered for driving a pile into the ground by a shocking power of striking the upper end of the pile by the weight member etc., or driving the pile gradually into the ground by adding a gentle pressure thereto. Although the former method is effective in case of driving the pile efficiently into the hard earth, it is not suitable for operation at a mass populated area since it makes a loud noise. On the other hand, the latter method has an advantage of being above to drive the pile into the ground gently without making a loud noise, but on the contrary, a friction resistance is large when the pile is driven into the ground, hence it is not easy to drive in the pile efficiently against said friction resistance.

The present invention is to improve such defects as above in which an endless chain which is engaged around upper and lower sprockets of a leader is driven, thereby compulsorily bring down a base body which is mounted to said chain. By the pull-down force of said base body, an earth auger applies a downward propelling force to an auger screw which is a member to be driven in.

Furthermore in this invention, a rotary power portion which constitutes the base body can be designed compactly and light weighted, thus said power portion can be installed easily, and the stability at the time of transportation is improved. This invention is also so designed that the pile driving machine can apply a sufficient power to drive in the pile which is a member to be driven in, and the pile can be driven into the ground efficiently without making a loud noise. If an arrangement is so made that said pile is driven into the ground gradually in movements up and down, the friction resistance against the pile can be reduced so that the pile can be driven in more easily.

By connecting an auger screw to an output shaft of the rotary power portion which is moved compulsorily by the chain, and further by providing a pile holding portion at a lower part of said rotary power portion, thereby the pile is installed in adjacent and parallel relationship with said auger screw, the pile can be driven into the ground along with a hole, dug by said auger screw, so that the pile can be driven quite easily even into the hard ground. If a rotary bracket is mounted free rotatingly at the lower outside of the rotary power portion where the auger screw is mounted, and the pile holding portion is provided on said rotary bracket, the pile, installed in said pile holding portion, can be turned easily to a desired direction during the non-operation time so that it is convenient, for example, to drive in U-section steel sheet piles interconnectingly and facing alternately in opposite directions on the occasion of building an enclosure at a building site.

In addition, if a pile inserting hole is provided in an internal member of a hollow supporting member which is moved compulsorily by the chain, and fixed holding teeth are arranged on one side of said inserting hole, while movable holding teeth are arranged on the other side thereof, and said two sets of teeth hold the pile, inserted between them, an optional portion along the length of said pile, for example an intermediate portion thereof, can be held so as to prevent a long and slender pile from being driven in a bent and/or inclined condition, in comparison with a chucking device of prior arts which holds a top portion of the pile from the upper side. In the said case, if said fixed holding teeth and said movable holding teeth are arranged on a rotary disk which rotates freely in relation to said supporting member, the direction of the pile can be turned easily during a non-operation time so that steel sheet piles, for example, can conveniently be driven in interconnectingly and facing alternately in opposite directions.

In case the upper end of a leader is connected free rotatingly to a crane so that the base body can be turned. Said leader is, by a leader fixing means, fixed at a certain angle during an operation time, and also said leader can be turned to an optional direction regardless the direction of said crane, hence said leader can conveniently face stationarily to a wall of a building, for example, even when the crane is positioned in parallel with said wall. If a leader fixing means is so arranged in the aforesaid case, that a rotary shaft on top of the leader is inserted freely movable up and down in a hole of the crane support, and spline convexities provided at the lower part of said rotary shaft are inserted in and out of spline grooves in said hole according to up-and-down movements of said rotary shaft, said leader when it is suspended from said crane can adjust its orientation, and when said leader is placed on the ground by lowering said crane, said spline convexities, provided at said rotary shaft, are inserted automatically in spline grooves inside the hole on the crane support, thus the direction of said leader can be fixed, and especially it is unnecessary to operate fixing means for fixing the leader. In case of another leader fixing means in which a first cylinder device is arranged at one side at the upper portions of a crane and a leader, while a second cylinder device is arranged at another side thereof, and each cylinder moves a similar distance back and forth in opposite directions, the turning of said leader can be remote controlled safely at a driver's seat of a crane. In addition, an unbalanced force will not be applied to a leader supporting portion by said first and second cylinders, and, by using pivotally attached cylinders, the angle between the crane and the leader can be altered freely.

Additional objects as well as features of this invention will become readily evident from the description set forth hereafter when considered in conjunction with explanations of accompanying drawings in which.

Figure 4:
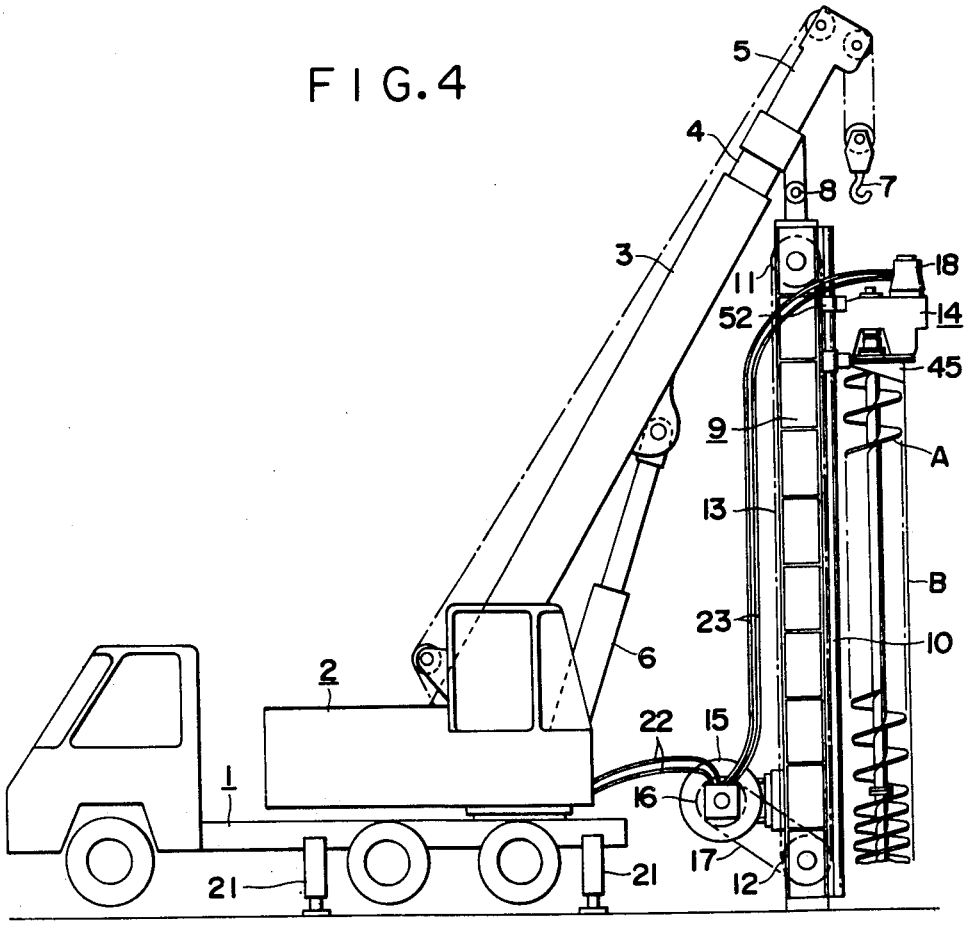
Figure 5:
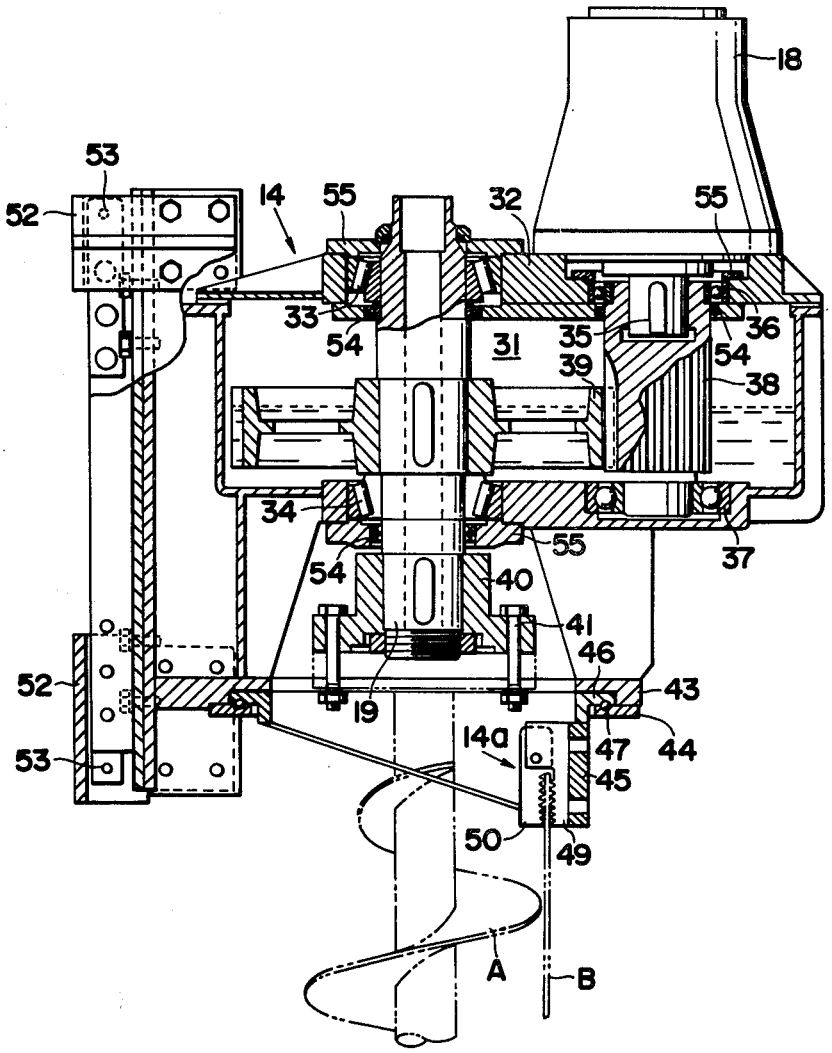
Figure 6:
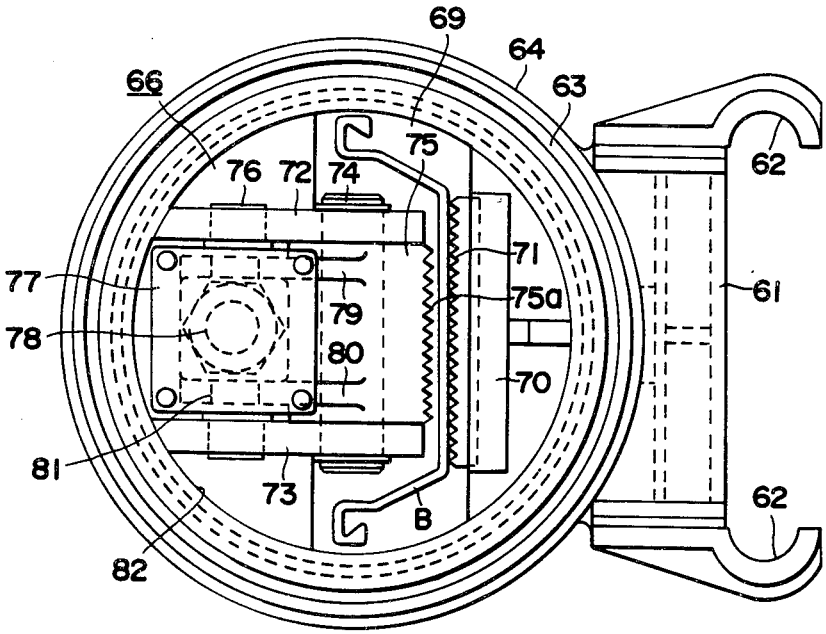
Figure 7:
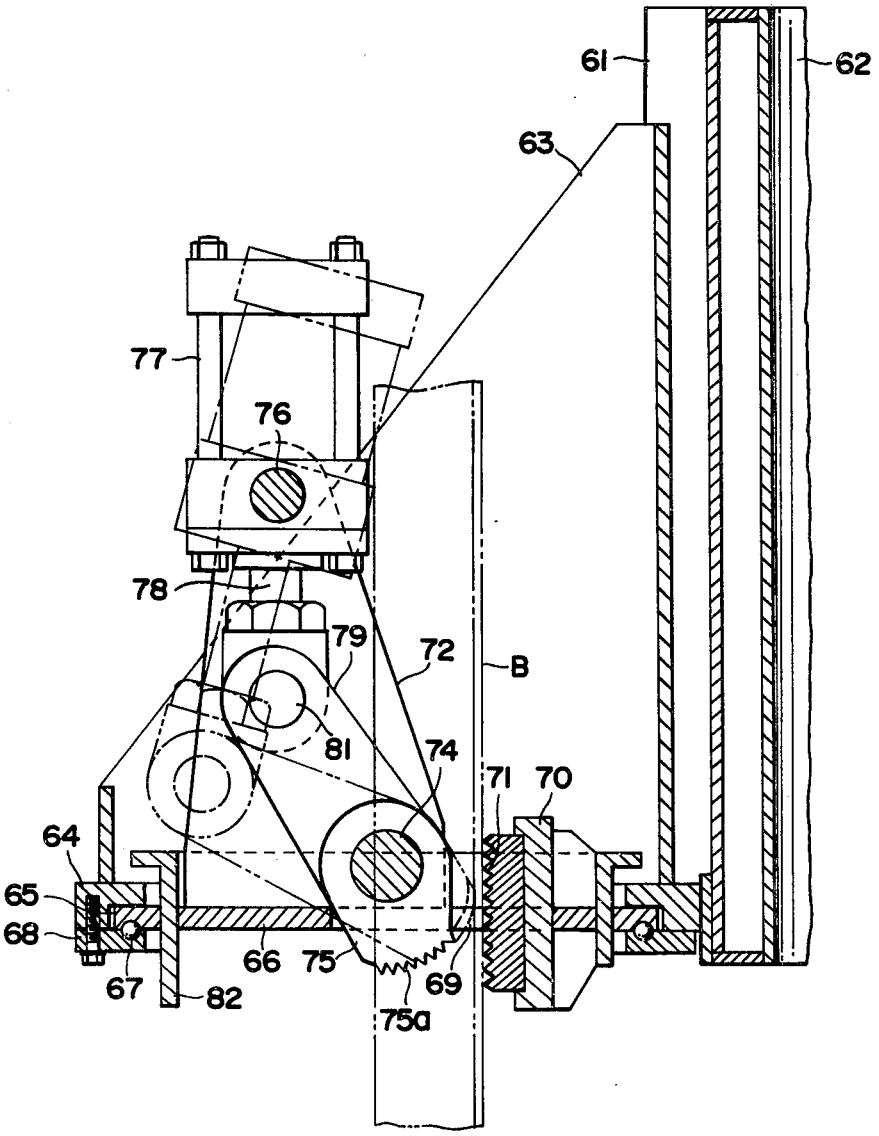
Figure 9:
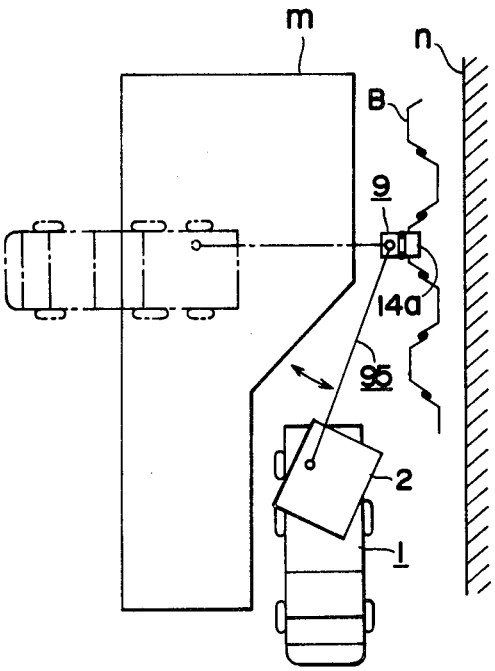
Figure 8:
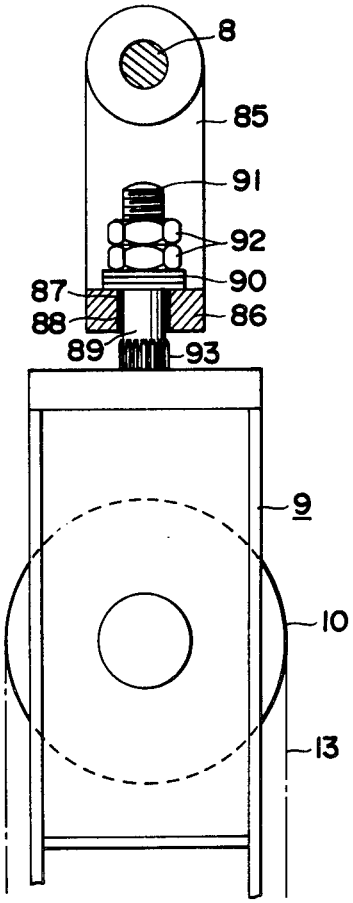
Figure 10:
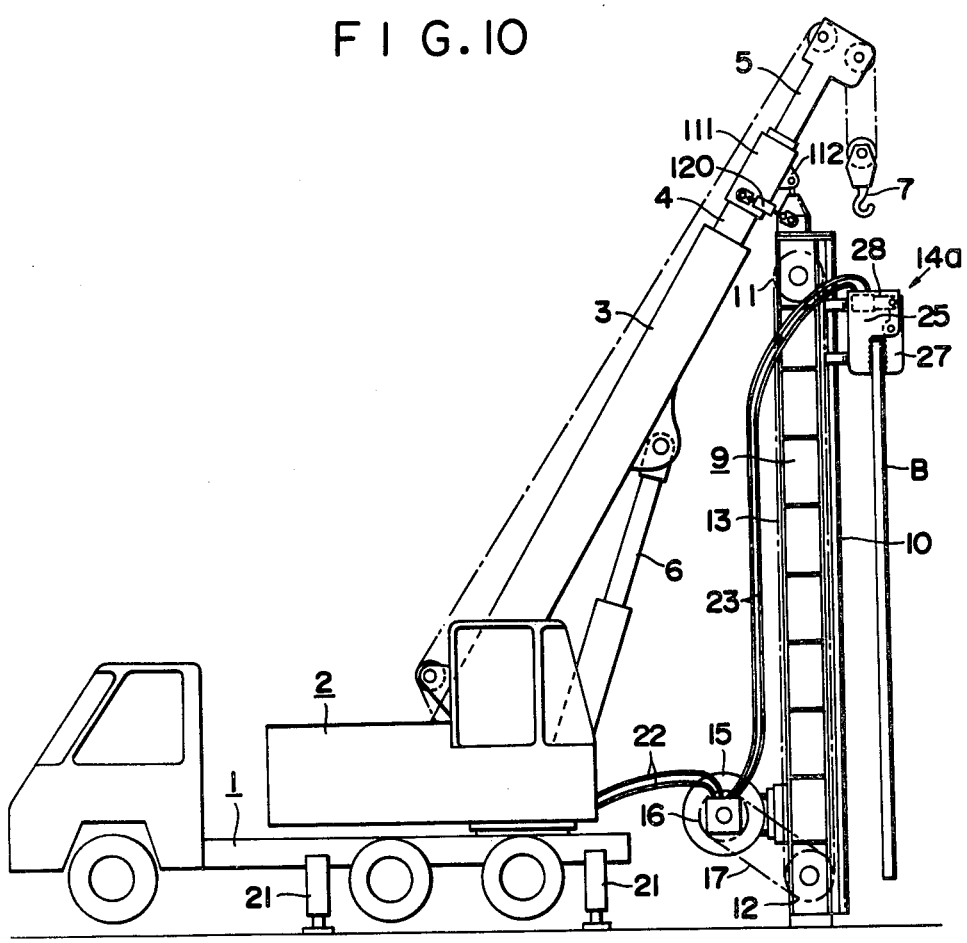
Figure 11:
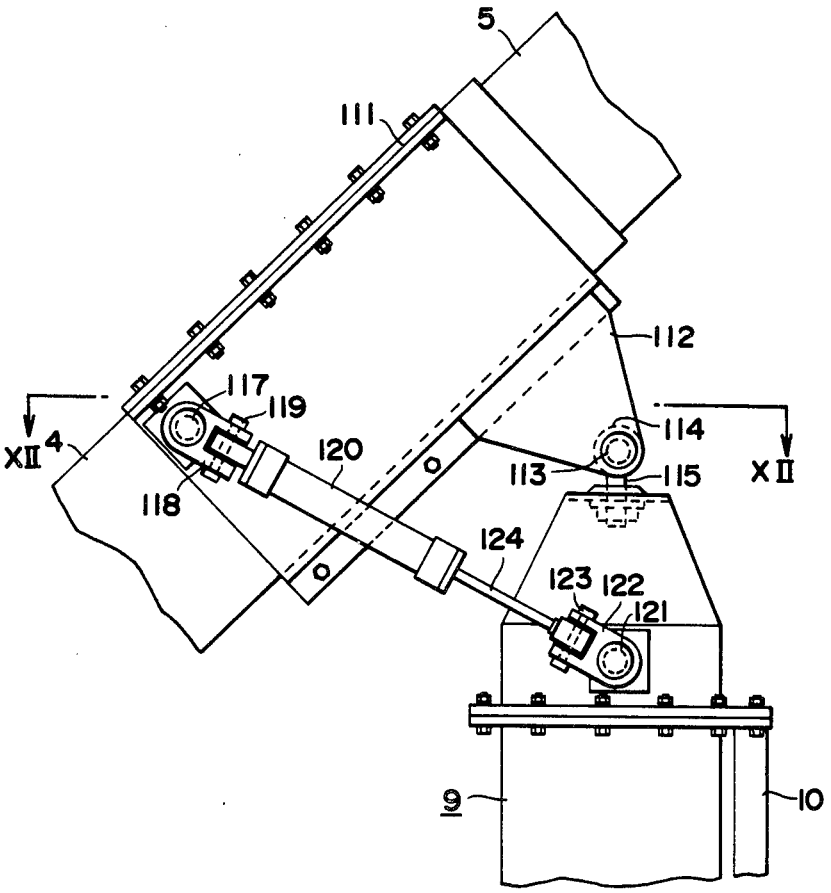
Figure 12:
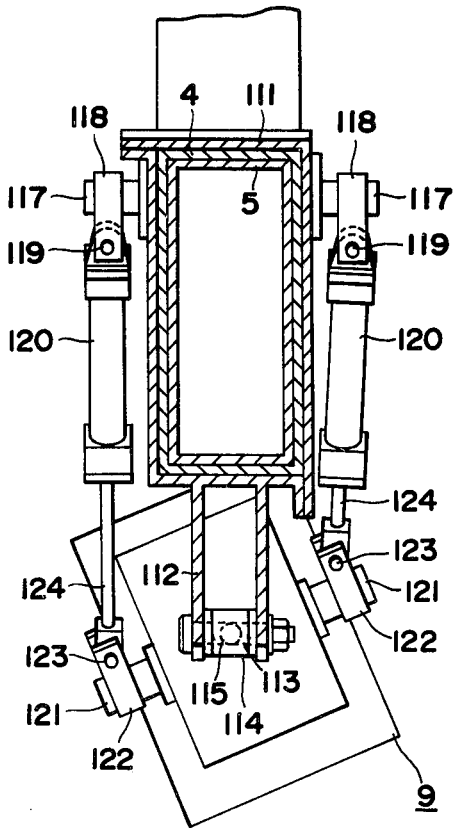

FIG, 3 is a side view of an embodiment of a pile driving machine;

FIG. 4 is a side view of an embodiment of a drilling and driving machine;

FIG. 5 is a vertical cross-sectional view of an essential portion of said drilling and driving machine;

FIG. 6 is a top plan view of an embodiment of a chucking device;

FIG. 7 is a vertical cross-sectional view of said chucking device;

FIG. 8 is a cross-sectional view of an embodiment of a direction adjusting device of a leader;

FIG. 9 is a top plan view, explaining operations of said adjusting device;

FIG. 10 is a side view of a pile driving machine, showing another embodiment of a direction adjusting device of said leader;

FIG. 11 is an enlarged view of an essential portion of FIG. 10;

FIG. 12 is a vertical cross-sectional view along with the line XII—XII of FIG. 11.

Figure 1:
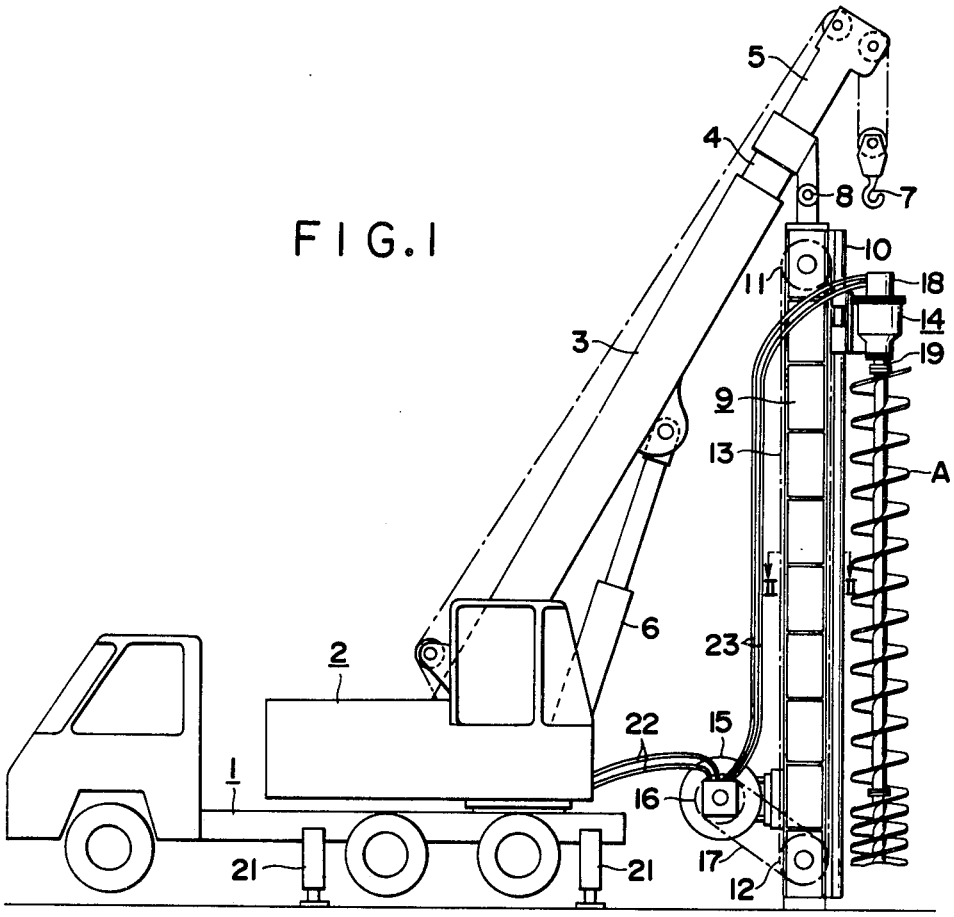
FIG. 1 is a side view of an embodiment of an earth auger.
Figure 2:
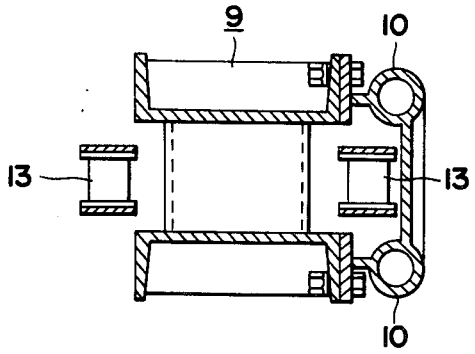
FIG. 2 is a cross-sectional view along the line II—II of FIG. 1.

An embodiment in which this invention is adopted in an earth auger will be described according to FIGS. 1 and 2.

On a base member (2) of a truck crane which is installed free rotatingly on a truck plate (1), a flexible boom is mounted which consists of a first stage boom (3), a second stage boom (4) which is inserted in said boom (3) freely movable back and forth and a third stage boom (5) which is inserted in said boom (4) freely movable back and forth. This flexible boom is let to rise and fall by a boom raising and lowering cylinder device (6), and at an extreme point of said third stage boom (5), a crane hook (7) is hung.

At the same time, a leader (9) in rod shape is connected to an extreme point of said second stage boom (4) through a leader joint (8), and said leader (9) is supported vertically to the ground by second stage boom (4). A pair of guide rails (10) (10) are fixed on the rear side of said leader (9), and an upper sprocket (11) and a lower sprocket (12) are supported free rotatingly at upper and lower ends of said leader (9) respectively. Then, an endless chain (13) is engaged around said upper sprocket (11) and said lower sprocket (12), and the chain is connected to a rotary power portion (14) which is a base body and moves up and down by sliding along said guide rails (10) (10). By an oil motor (15) of a low-speed and a high-torque which is mounted on the lower portion of said leader (9) and acts as a power source, said lower sprocket (12) is driven through a driving sprocket (16) as well as a driving chain (17), whereby said endless chain (13) is turned so that said rotary power portion (14) is caused to rise and fall. Said rotary power portion (14) comprises a decelerator and an oil motor (18) of a low-speed and a high-torque which is mounted on top of said decelerator, while an upper end of an auger screw (A) which is a member to be driven in, is connected to an output shaft (19) of said rotary power portion (14).

In the meantime, (21) in the drawing is an outrigger which fixes the truck during an operating time, and (22) (23) are pressure resisting rubber hoses which supply operating oil from an oil pump (not shown in the drawing), installed in said base member (2) of the truck crane, into said oil motor (15) (18) respectively.

Thus, oil is supplied to said oil motor (18), whereby said rotary power portion (14) is driven, while oil is also supplied to said oil motor (15), whereby said chain (13) is turned, so that said rotary power portion (14) is brought down compulsorily, giving a downward propelling force to said auger screw (A), and a hole is dug in the ground.

Figure 3:
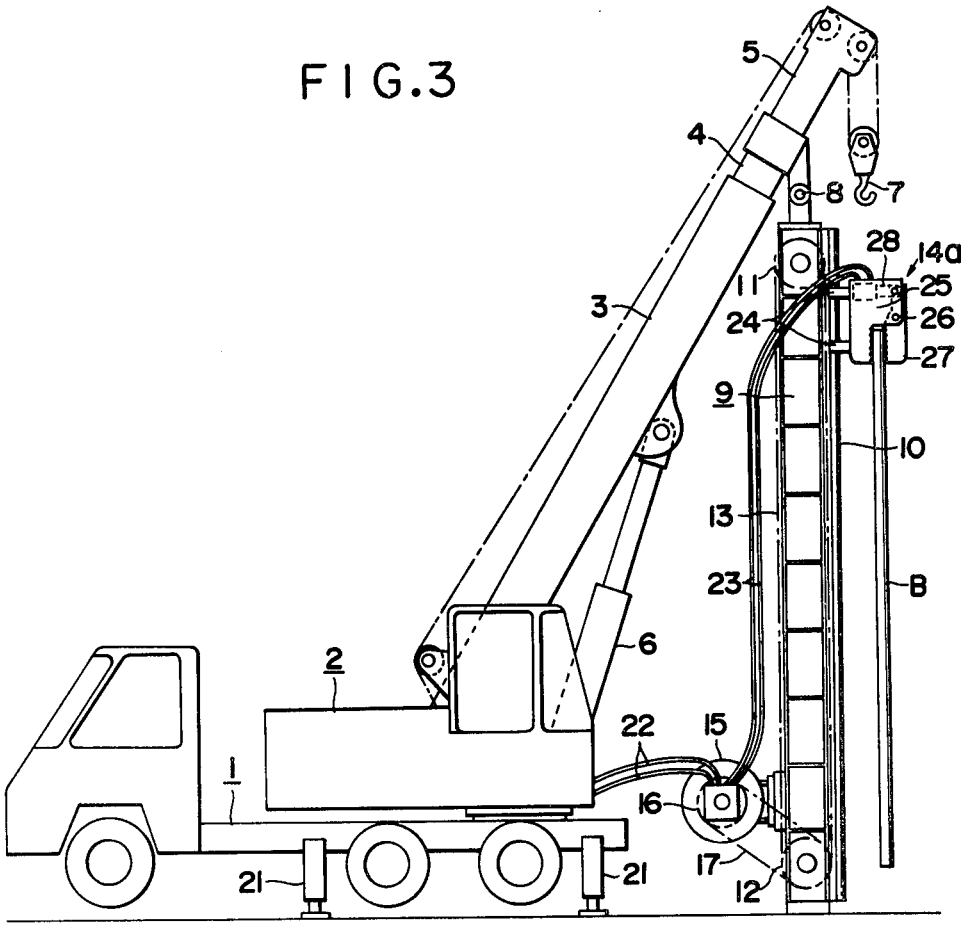

An embodiment in which this invention is adopted in a pile driving machine will be described next according to FIG. 3. Respective parts similar to the earth auger in said FIGS. 1 and 2 are designated with same reference numerals and explanations thereof are omitted.

Said endless chain (13) is connected to a pile holding portion (14*a*) which is a base body, and moves up and down by sliding along said guide rails (10). In said pile holding portion (14*a*), a fixed holding portion (25) is mounted through holders (24) (24) to said leader guide rails (10), while a movable holding portion (27) is mounted freely pivoted through a supporting shaft (26) to said fixed holding portion (25), then a lower end of said movable holding portion (27) is driven back and forth by an oil cylinder device (28), and holding teeth of said both holding portions (25) (27) hold a pile (B) which is a member to be driven in, like a steel sheet pile or so.

Now, by means of switching an oil pressure switching valve (not shown in the drawing) by an operator's hands, or by means of switching the hydraulic circuit of pressurized oil from a source automatically by a solenoid valve or the like (not shown in the drawing) which is operated in accordance with a signal, designated by a timer (not shown in the drawing), said oil motor (15) is driven clockwise and counter clockwise alternately, and the overall pile holding portion (14*a*) is brought down gradually while it is moved cyclically up and down through said endless chain (13), thus said pile (B), held by said pile holding portion (14*a*), is driven progressively into the ground with reciprocative advancing motion. In case said pile (B) is moved cyclically up and down while being progressively driven into the ground as aforementioned, a friction factor of said pile (B) can be reduced, compared with the case when said pile (B) is driven gently directly into the ground, so that the friction resistance of the earth against said pile (B) is decreased.

An embodiment of a drilling and driving machine of this invention will be explained next according to FIGS. 4 and 5. Respective parts similar to the earth auger in said FIGS. 1 and 2 are designated with same reference numerals and explanations thereof are omitted.

This drilling and driving machine digs a hole in the ground and, at the same time, drives a pile or a steel sheet pile, for example, into the ground along with said hole.

The rotary power portion (14), as shown in FIG. 5, has an oil room (31) inside thereof, and an oil motor (18) is fixed on one side of a cover (32) of said oil room (31), while said output shaft (19) is supported free rotatingly by a bearing (33) which is fixed on the other side of said cover (32) and also by a bearing (34) which is mounted at the lower side of said oil room (31), and inside said oil room (31), a pinion (38) which is mounted on said shaft of said oil motor (18) and is supported by bearings (36) (37), is engaged with a gear (39) which is mounted on said output shaft (19). Then, a coupling (40) is mounted on the lower portion of said output shaft (19) which is thrusted out of the oil room (31), and the upper end of said auger screw (A) is supported by fastening bolts (41) of said coupling (40).

On the other hand, a flange portion (46), located at an upper end of a cylindrical rotary bracket (45) which is formed at its lower end in an inclined shape, is supported free rotatingly between a lower portion (43) of said rotary power portion (14) and a ball retainer (44)

which is mounted on said lower portion (43), and steel balls (47) are arranged under a contacting surface of said upper end flange portion (46).

In addition, fixed teeth (49) of an oil pressure chuck (14*a*) which is a pile holding portion, are fixed on a wide portion of said rotary bracket (45), while movable teeth (50) are supported free rotatingly by said fixed teeth (49), and said movable teeth (50) are turned by being moved at the upper end right and left by an oil cylinder (not shown in the drawing). Said pile (B) like a steel sheet pile, held by said oil pressure chuck (14*a*), is hung adjacent to an outer circumference of said auger screw (A).

In the meantime, (52) in FIG. 5 is a slide bracket which is fixed on the left side of said rotary power portion (14), and engages with said guide rails (10) of said leader (9), (53) is a joining portion of said endless chain (13), (54) is an oil seal which is inserted in said output shaft (19) and on the upper end portion of said pinion (38), and (55) is a bearing holder.

Now, operations are so made that oil is supplied to said oil motor (18), whereby said auger screw (A) is driven, while oil is also supplied to said oil motor (15), whereby said chain (13) is driven so that said rotary power portion (14) is brought down compulsorily so as to give a downward propelling force to said auger screw (A) for digging a hole in the ground. At the same time, said pile (B) which has been prepared adjacent to the outer circumference of said auger screw (A) is driven into the ground together with said auger screw (A).

While said pile (B) is being driven in, said rotary bracket (45) does not turn due to a friction resistance which arises at the upper surface of said upper end flange portion (46) of said rotary bracket (45), on the other hand, in the condition when said rotary power portion (14) is pulled up to an upper portion of said leader (9) so that said pile (B) is in suspension, said rotary bracket (45) can be supported free rotatingly by said steel balls (47) which are arranged at the lower surface of said upper end flange portion (46) of said rotary bracket (45), thus said pile (B), like a steel sheet pile, can be turned to an optional direction within the outer circumference of said auger screw (A).

An embodiment of a chucking device of said pile driving machine of this invention which holds said pile, a steel sheet pile or the like, will be described next according to FIGS. 6 and 7.

(61) is a sliding member which is supported movably up and down on said guide rails (10) of leader (9) in said pile driving machine, and (62) is a sliding groove thereof. A hollow, cylindrical supporting member (63), an upper portion thereof being formed in inclined shape, is welded to the front surface of said sliding member (61), while a circle groove (65) is formed on the inner circumference of a ring shaped thick portion (64) which is fixed at the lower end of said supporting member (63), and the outer circumference of a rotary disk (66) which is an internal member, is mounted free rotatingly on said circle groove (65), then said rotary disk (66) is, through a steel ball (67) arranged at the lower side of the outer circumference of said disk (66), supported free rotatingly by a circle shaped receiving member (68) which is fixed at the lower side of said ring shaped thick portion (64).

A pile inserting hole (69) is provided at about center of said rotary disk (66), while a supporting plate (70) is fixed at the inner end of one side of said inserting hole (69), and fixed holding teeth (71) are fixed at the inner side of said supporting plate (70).

Crossing said inserting hole (69) and facing toward said fixed holding teeth (71), a pair of brackets (72) (73) are mounted at regular interval on the other upper side of said rotary disk (66), while a movable holding teeth member (75) which faces to said fixed holding teeth (71) is supported free rotatingly through a supporting shaft (74) at the lower portion of said pair of brackets (72) (73). The cross section of said movable holding teeth member (75) is approximately a tangent cam shape, at one side of the most displaced portion of which movable holding teeth (75*a*) of a circular arc shape are formed. The power structure of said movable holding teeth (75*a*) is so arranged that an oil cylinder (77) is supported free rotatingly through a supporting shaft (76) at upper end portion of said pair of brackets (72) (73), and also extreme ends of a pair of levers (79) (80) which are fixed to the rear side of said movable holding teeth member (75), are connected free rotatingly through a supporting shaft (81) at the extreme end of a piston rod (78) of said oil cylinder (77).

The central part and circumferential part of said rotary disk (66) are made of different materials and are formed in one body through a cylindrical member (82).

Said pile (B) like a U-section steel sheet pile is inserted in the inserting hole (69) of said rotary disk (66), and said fixed holding teeth (71) as well as said movable holding teeth member (75) are facing each other at a desired height of said pile (B). Then, operating oil is supplied to said oil cylinder (77), thereby said piston rod (78) thereof is pushed down, and said movable holding teeth member (75) is rotated counter clockwise through said levers (79) (80). According to the above, said movable holding teeth (75*a*) moves to the side of said fixed holding teeth (71), and said pile (B) is held firmly by both of said holding teeth (71) (75*a*). When said pile (B) is being driven into the ground, an upward force is applied to said movable holding teeth (75*a*) through said pile (B) so that said movable holding teeth member (75) tends to turn counter clockwise further, and at this time, said movable holding teeth (75*a*) which are formed at one side of the thickest portion of the tangent cam, sink increasingly into said pile (B), therefore the holding power thereof increases.

Before said pile (B) which is held by said holding teeth (71) (75*a*), is driven into the ground, an operator can adjust freely the position or orientation of said pile (B), like the U-section steel sheet pile, by turning it by hand operation since said rotary disk (66) is supported free rotatingly by said steel ball (67). When the pile is being driven in, the position of said rotary disk (66) is fixed by the friction resistance between the upper side of outer circumference of said rotary disk (66) and inner side of said groove (65), located at said ring shaped thick portion (64).

The leader (9) shown in the embodiments of FIGS. 1–7 is arranged vertically by suspending the upper end of said leader (9) by the crane. However, the suspending means is not limited to the crane and the lower portion of the leader (9) can be supported by the boom supporting means of an oil pressure shovel, for example. Namely, the lower portion of the leader (9) is supported rotatably by the supporting portion of the main body of the oil pressure shovel and an oil cylinder is provided between said main body and said leader (9), so that the leader (9) may be raised and lowered by extending and retracting the piston rod of said oil cylinder.

An embodiment of an orientation adjusting device of said leader in said earth auger and said pile driving machine of this invention will be explained next according to FIGS. 8 and 9. Explanations and drawings are omitted in regard to respective parts similar to the pile driving machine in the FIG. 3.

An upper end of a supporting member (85) is mounted free rotatingly on the leader joint (8), located at an extreme point of crane (95), while a receiving member (86) is fixed at the lower end of said supporting member (85), and a leader fixing means is arranged at said receiving portion (86). The leader fixing means is so arranged that a hole is provided on a vertical axis at the central part of said receiving member (86), and plurality of spline grooves (88) are arranged on the inner circumference of said hole (87) at regular intervals. On the other hand, a rotary shaft (89) is fixed at the upper end of said leader (9), while said rotary shaft (89) is inserted in said hole (87) so as to be moved in an axial direction as much distance as designated, then a thrust bearing (90) is mounted on the upper thrusted portion of said rotary shaft (89), in addition, double nuts (92) is engaged to a screw portion (91) of said rotary shaft (89), then said thrust bearing (90) and said double nuts (92) are fixed at the upper side of said receiving member (86) so that a weight, to be imposed on said rotary shaft (89), can be supported. Furthermore a plurality of spline convexities (93) are formed at regular intervals on the lower portion of said rotary shaft (89), and said spline convexities (93) are inserted in and out said spline grooves (88) by movements of said rotary shaft (89) along its axial direction.

Under the condition when said leader (9) is suspended from said crane (95), workers who are under said leader (9) may turn said leader (9) by hand or the like so that the pile holding portion (14*a*) which is a base body, is turned to a orientation or direction.

Then, said crane (95) is lowered so as to stand said leader (9) on the ground, at the same time, said supporting member (85) is lowered, whereby said spline convexities (93) of said rotary shaft (89) are inserted into said spline grooves (88) of said receiving member (86), thus the direction of said leader (9) is fixed.

If the direction adjusting device of said leader (9) is so arranged as above, said truck (1) can advance, even when there is an obstacle (m) as shown in FIG. 9, for example, between said obstacle (m) and a wall (n), and turn said crane so that said leader (9) is positioned at a designated place without being limited too much by the place where said truck (1) stopped, at this time said leader (9) turns its direction in relation to said crane (95), and said pile holding portion (14*a*) of said leader (9) can always face to the front of said wall (n).

Another embodiment of said orientation adjusting device of said leader of this invention will be described next according to FIGS. 10 through 12. Respective parts similar to the pile driving machine in the FIG. 3 are designated with same reference numerals and explanations thereof are omitted.

A supporting member (111) is mounted and fixed on the extreme portion of said second stage boom (4) of the crane, while a pair of brackets (112) are fixed on the front side of said supporting member (111), and a ring shaped member (114) is mounted free rotatingly on a point between said pair of brackets (112) of a supporting shaft (113), then the upper end of said leader (9) is mounted free rotatingly to a lower shaft portion (115) of said ring shaped member (114).

Supporting shafts (117) are fixed on both sides of said supporting member (111) of said second stage boom (4), while said both supporting shafts (117) are inserted in rotary members (118), then both of said rotary members (118) are connected free rotatingly through pins (119) to base ends of oil cylinders (120) of said first and second cylinder devices respectively. On the other hand, supporting shafts (121) are provided at both sides of the upper end portion of said leader (9), and said supporting shafts (121) are inserted in rotary members (122) to which extreme points of piston rods (124) of both of said oil cylinders are connected free rotatingly through pins (123) respectively. Said first and second cylinder devices are said leader (9) rotating means as well as said leader (9) fixing means.

The operator who is in said base member (2) of the truck crane switches an oil pressure switching valve (not shown in the drawing), thereby thrusts out one piston rod (124) out of said pair of oil cylinders (120) as much distance as designated, at the same time, retracts the other piston rod (124) by the similar distance, thus said leader (9) rotates on the axis of said lower shaft portion (115). By the above operation, said pile (B) like a steel sheet pile or so which is a member to be driven in, is turned to a desired direction. After the adjustment as above, said oil motor (15) is actuated so that said endless chain (13) turns around whereby said pile holding portion (14*a*) which is a base body, is brought down, and said pile (8) is driven into the ground.

Furthermore, this leader rotating device can be adopted not only to said pile driving machine but also to an earth auger.

What is claimed is:

1. A building machine for driving vertical members, comprising, a leader which is supported vertically during a driving operation, upper and lower sprockets mounted rotatably at upper and lower positions respectively of said leader, an endless chain which is engaged around the upper and lower sprockets of said leader, powered means for driving said chain, a base body connected to said chain and forced by said chain to move vertically along said leader, the base body also being engagable with a member to be driven, a crane having pivotal supporting means connecting with the upper end of said leader for rotation of the leader about a vertical axis whereby said base body can be turned in different directions, and leader fixing means between the crane and the leader for fixing the rotation of said leader.

2. A building machine as claimed in claim 1, wherein said leader fixing means includes a supporting member defining a hole or bore positioned vertically with the leader and a plurality of spline grooves on the circumference thereof, and the upper end of said leader has a rotary shaft slidably inserted in said hole and movable up and down, an upper portion of the shaft being freely rotatable in the hole of the supporting member, and a lower portion having spline convexities which slide in and out of said spline grooves with vertical movements of said rotary shaft and leader to fix and release leader rotation.

3. A building machine as claimed in claim 1, wherein said leader fixing means includes first cylinder means which is arranged between one upper, lateral side of said crane and said leader, and second cylinder means which is arranged between the other upper, lateral side of said crane and said leader for orienting the leader about a vertical axis.

* * * * *

UNITED STATES PATENT AND TRADEMARK OFFICE

CERTIFICATE OF CORRECTION

PATENT NO. : 4,195,698

DATED : April 1, 1980

INVENTOR(S) : Tadashi Nakagawasai

It is certified that error appears in the above-identified patent and that said Letters Patent are hereby corrected as shown below:

On the Title Page: the Assignee should be indicated as follows:

Assignee: Youmatu Shimoda, Maebashi, Japan;
a part interest

Signed and Sealed this

*Second* Day of *September 1980*

[SEAL]

*Attest:*

SIDNEY A. DIAMOND

*Attesting Officer*

*Commissioner of Patents and Trademarks*